US006230604B1

(12) United States Patent
Larson et al.

(10) Patent No.: US 6,230,604 B1
(45) Date of Patent: May 15, 2001

(54) CONCENTRIC CANISTER LAUNCHER

(75) Inventors: Lowell Richard Larson, Andover; Garry Lee Teigland, Rosemount; Neil Anderson, Loretto; James M. Ickstadt, Minneapolis; Virgil F. Voeller, II, Fridley; John D. Buehler, Eagan; Angela Flakne, Maple Grove, all of MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 09/006,512

(22) Filed: Jan. 13, 1998

Related U.S. Application Data

(60) Provisional application No. 60/035,495, filed on Jan. 14, 1997, now abandoned.

(51) Int. Cl.[7] ..... F41F 3/052; F41F 3/077

(52) U.S. Cl. ..... 89/1.817; 89/1.812; 89/1.819

(58) Field of Search ..... 89/1.817, 1.816, 89/1.818, 1.819, 1.8, 1.801, 1.806, 1.807, 1.808, 1.809, 1.81, 1.812

(56) References Cited

U.S. PATENT DOCUMENTS

| | | | | |
|---|---|---|---|---|
| 2,903,124 | * | 9/1959 | Carver | 89/1.819 |
| 3,158,062 | * | 11/1964 | Feiler | 89/1.817 |
| 3,769,876 | * | 11/1973 | Haas et al. | 89/1.817 |
| 3,924,511 | * | 12/1975 | Kendall et al. | 89/1.8 |
| 4,044,648 | * | 8/1977 | Piesik | 89/1.816 |
| 4,470,336 | * | 9/1984 | Swann et al. | 89/1.815 |
| 4,471,684 | * | 9/1984 | Johnson et al. | 89/1.815 |
| 4,686,884 | * | 8/1987 | Piesik | 89/1.816 |
| 5,327,809 | * | 7/1994 | Matteson et al. | 89/1.817 |

* cited by examiner

*Primary Examiner*—Stephen M. Johnson
(74) *Attorney, Agent, or Firm*—Ronald C. Kamp

(57) ABSTRACT

A canister for launching a missile having a cylindrical outer tube with a hemispherical head releaseably secured to its lower end connected through stiffeners to an inner tubular member to form a passage for the gases generated when the missile is fired. A restraint mechanism secures the missile to a base plate, which is itself mounted on shock absorbers, with a release mechanism responsive to the firing of the missile for disabling the restraint mechanism.

1 Claim, 14 Drawing Sheets

CONCENTRIC CANISTER LAUNCHER

CROSS-REFERENCE TO RELATED APPLICATION

This application is based on a U.S. provisional application filed Jan. 14, 1997, having Ser. No. 60/035,495 now abandoned and priority in that application is claimed for this application.

BACKGROUND OF THE INVENTION

This invention relates to launchers for missiles and, more particularly, to such launchers for missiles which are encapsulated within canisters.

Encapsulating missiles within a canister is desirable because it provides a convenient and safe way to ship, handle and launch the missiles. The prior art canisters were arranged in cells requiring the gases generated by the missile's burning motor to be vented through a common path. This arrangement concentrated stresses and erosion on certain components of the gas management system because such components were subjected to the gases generated by multiple missiles, resulting in a short life for the gas management system as well as frequent and expensive maintenance of such system. The restraint means for the missile, i.e. the means for securing the missile in its associated canister, could fail when the missile was fired. Protection against the hazards associated with such restrained firings was provided in the prior art launchers in the form of a deluge and drain system. Provision for such a system undesirably added to the complexity, cost, maintenance and weight of the launcher. Increased weight is particularly undesirable when the launcher is to be installed aboard a ship. The prior art canisters also required a launching system in which the electronics for the control system located external to the canister were unique to the particular missile in the canister. Consequently, a change in the type of missile within the canister necessitated a change in the control system, making the installation of a new or different missile expensive and delaying the integration of a new missile throughout the fleet.

BRIEF SUMMARY OF THE INVENTION

The present invention is a canister launcher which overcomes the above-described problems and limitations associated with the prior art canister launchers, which provides integral gas management (i.e. self-contained management of the products of combustion resulting from burning of the motor in the missile contained in that particular canister), which provides positive release of the missile from the canister upon ignition of the missile's rocket motor, which prevents restrained firing of the missile within the canister, which eliminates the need for a deluge and drain system normally required in canister launchers to reduce the deleterious effects of, and hazards to the ship and its personnel associated with, restrained firing, which provides a launcher of light weight and corrosion resistance, which provides integral shock mitigation for the missile, which permits mounting of the launcher above deck, which is resistant to the wide range of hostile environmental conditions encountered at sea, which provides an open electronics architecture, which is modular and which requires no changes in the control system to deploy a new missile, and which may economically and readily installed in a variety of ship configurations.

The foregoing advantages of the present invention, and many of the attendant attributes thereof, will become more readily apparent from a perusal of the following description of preferred embodiments and the accompanying drawings, wherein:

DETAILED DESCRIPTION OF THE INVENTION

Figure 1:
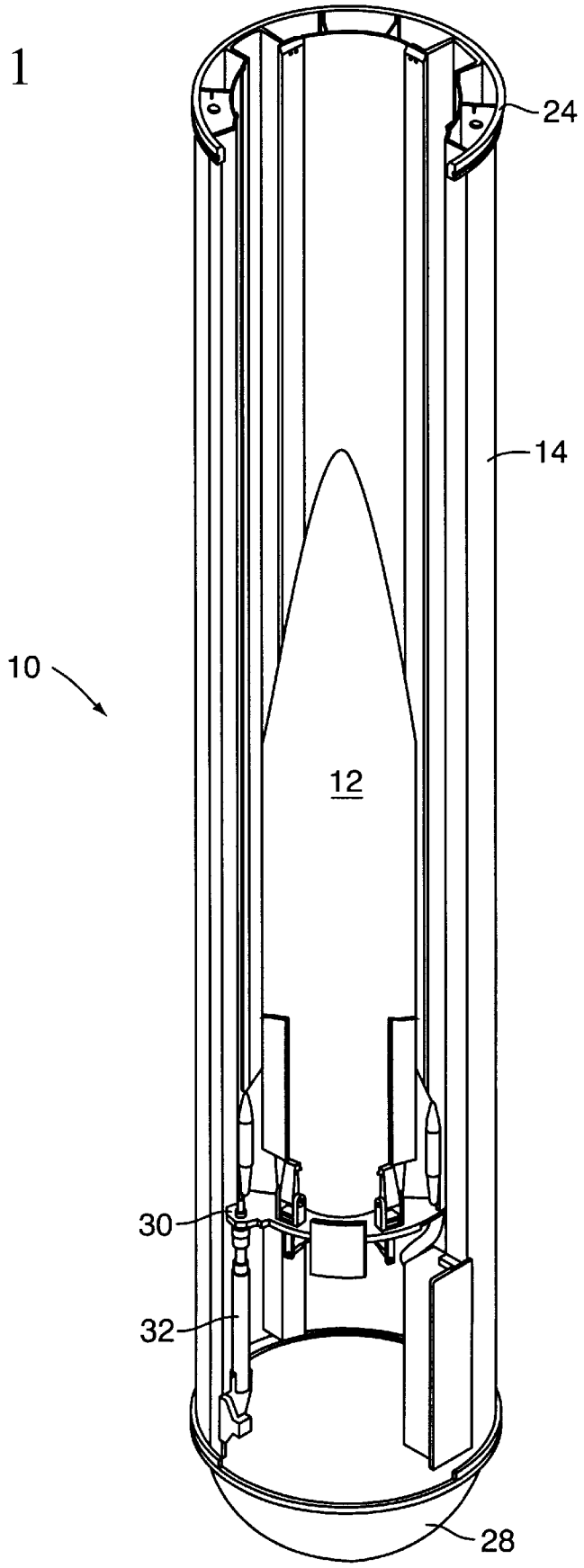
FIG. 1 is a view of a missile in a canister, with portions broken away for clarity, constructed according to the present invention.

Referring to FIGS. 1–5, there is shown a canister, indicated generally at 10, with a missile 12 restrained therein. The particular missile 12, shown for purposes of illustration, is a TACMS (Tactical Missile System) missile. The canister 10 has a fabricated cylindrical outer tube 14 and generally cylindrical inner tubular member 16. The member 16 may be actually cylindrical if the fins on the missile do not extend, when folded, beyond the outer periphery of the missile, as in the case of the Tomahawk missile. Because fin pockets are required to accommodate the fins and the hinges mounting the same to the missile, the member 16 is formed of four cylindrical sections 18 separated by and secured to a generally U-shaped members 20, with the latter having a cross section shaped to function as fin pockets. The tunnels formed by the spacing between the outer tube 14 and the tubular member 16 form uptake passages 17 for the exhaust of gases produced by the motor of the missile 12. In order to weld or otherwise secure the U-shaped members 20 to the outer tube 14, cylindrical panels are provided in the outer tube 14 which are not secured to the outer tube 14 until after the U-shaped members 20 are secured to the outer tube 14. Although the members 20 function as stiffeners and reduce the inward deflection of the sections 18 under the pressure of the gases within the uptake passages, stiffeners 19 are also positioned within the uptake passages 17, extending along their length, and are secured to the outer tube 14 and to the sections 18. The stiffeners 19 are first secured to the cylindrical sections 18 and then to the outer tube 14, which is accomplished by forming a plurality of aligned slots in the outer tube 14 through which tabs on the stiffeners 19 extend and are welded. Fly-out guides 22 are secured to the tubular members 16 to properly direct the missile 12 as it is launched. A circular flange 24 encircles and is secured to the upper end of the outer tube to add structural stability to the upper end of the tube 14. A similar flange 26 encircles and is secured to the lower end of the outer tube 14. A hemispherical head 28 is removably secured to the lower flange 26, preferably by bolts, and seals the lower end of the canister 10. The inner surface of the hemispherical head 28, which is formed of stainless steel, is coated with an ablative material to resist the erosion resulting from the flow of high temperature gases produced by the missile's motor. The head 28 serves to turn and redirect such gases through the uptake passages 17. The sections 18 and the members 20 terminate a short distance above the level of the lower flange 26 to permit free entry of the gases, redirected by the head 28, into the passages 17. This arrangement provides integral gas management, i.e. management of the gases entirely within the confines of the canister itself, and is often referred to as a concentric canister launcher (CCL). In order to keep the weight of the canister low and to provide good corrosion resistance, the foregoing components, except for the head 28 and guides 22, are made of titanium or other appropriate material.

Figure 3:
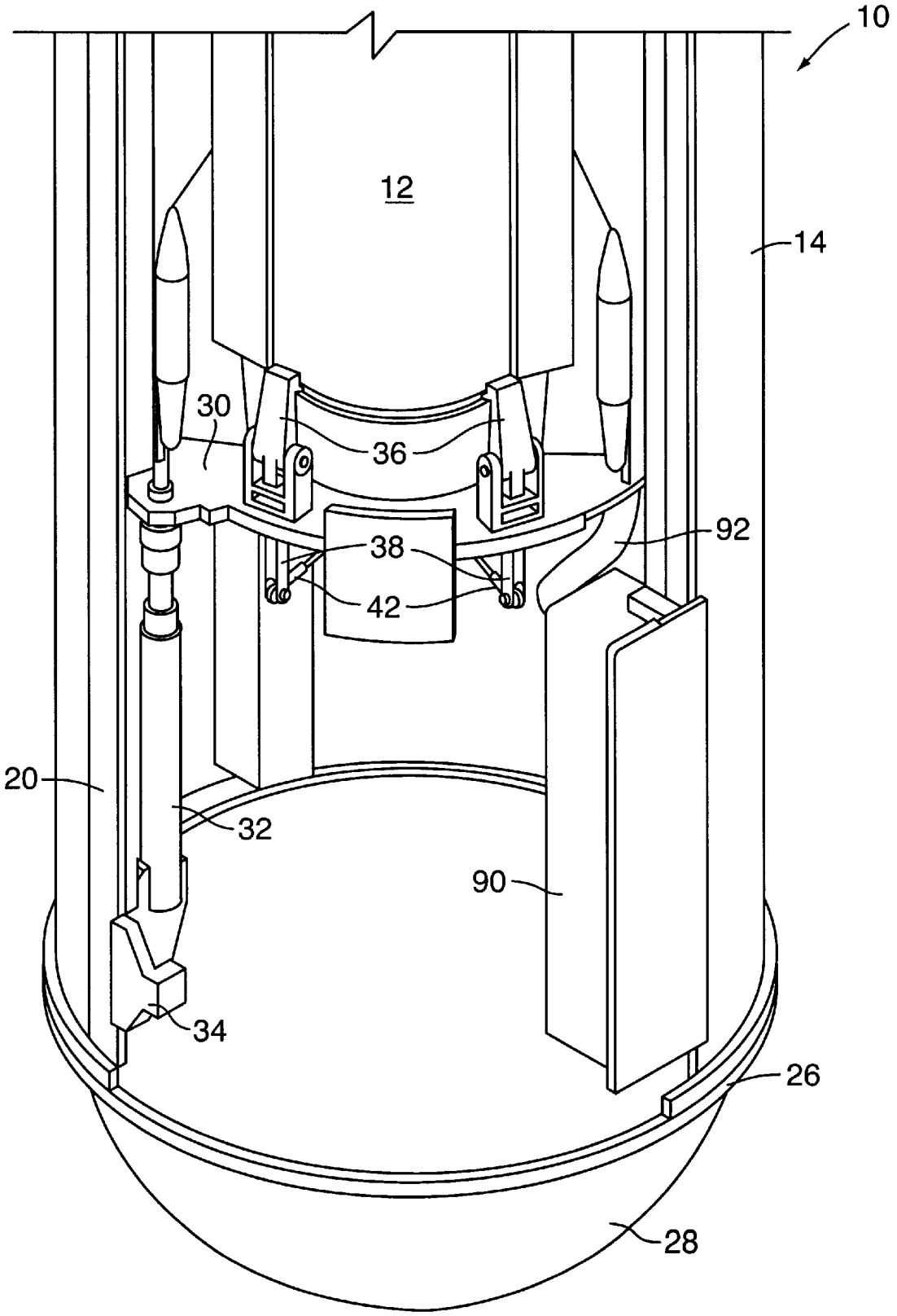
FIG. 3 is a more detailed view of the lower portion of the canister and missile shown in FIG. 1.
Figure 4:
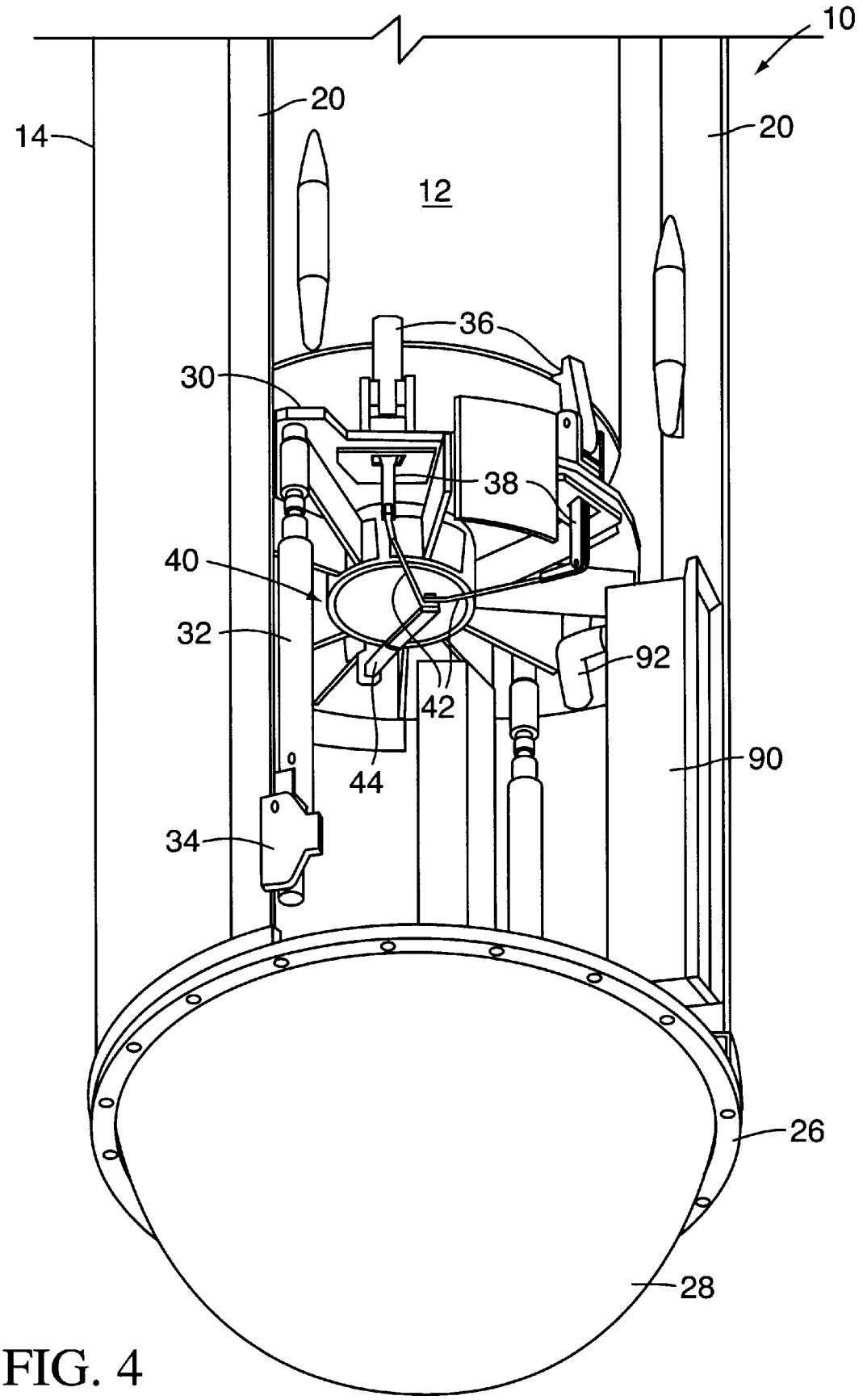
FIG. 4 is a view similar to FIG. 3 showing the means for positively releasing the missile from the canister.
Figure 5:
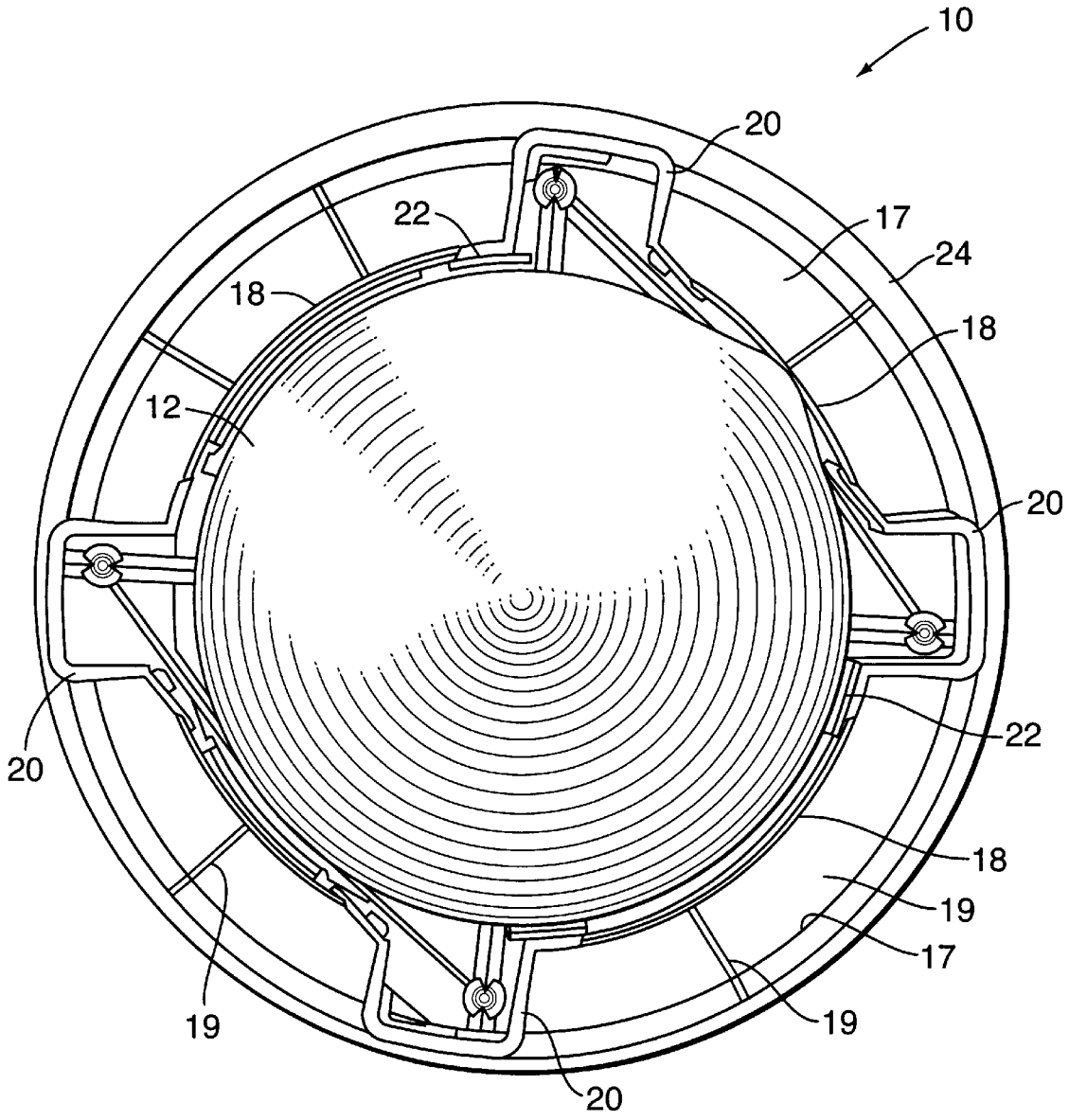
FIG. 5 is a top view of the canister and missile shown in FIG. 1.

As best seen in FIGS. 3 and 4, the lower end of the missile 12 rests upon a base plate 30 supported by a plurality of shock absorbers 32, each of which is pinned to a bracket 34 secured to an adjacent U-shaped member 20. This arrangement provides shock mitigation integral to the canister 10 for the missile 12. Three levers 36 are pivotally mounted on brackets secured to the base 30 and have projections or dogs on their upper ends that are engageable with complementary recesses formed in the missile 10. The lower ends of the levers 36 are pinned to links 38 which extend though, and are fulcrumed on, openings in the base plate 30. The lower end of the links 38 are pinned to a release mechanism 40, which mechanism includes two tension links 42 pinned to a third link 44. The third link 44 is a fusible link which separates or comes apart upon exposure to high heat. The two links 42 are shorter than the link 44 in order to position the link 44 directly in the flow of the high temperature gases created upon firing the missile 12. The dogs on the levers 36 remain engaged with the recesses in the missile, securing the missile 10 to the base plate 30, as long as the link 44 remains a unitary structure. However, upon exposure to the high temperature gases created upon firing the missile 12, the link 44 comes apart permitting the dogs to disengage from the missile recesses. Thus, the release mechanism is directly responsive to the firing of the missile and restrained firing is precluded. The link 44 may be made by forming engageable flats on overlapping ends of segments of the link 44 and joining the flats by a means, such as soldering, which fails upon exposure to the high temperatures of the missile's combustion products, but is otherwise structurally sound.

Figure 6:
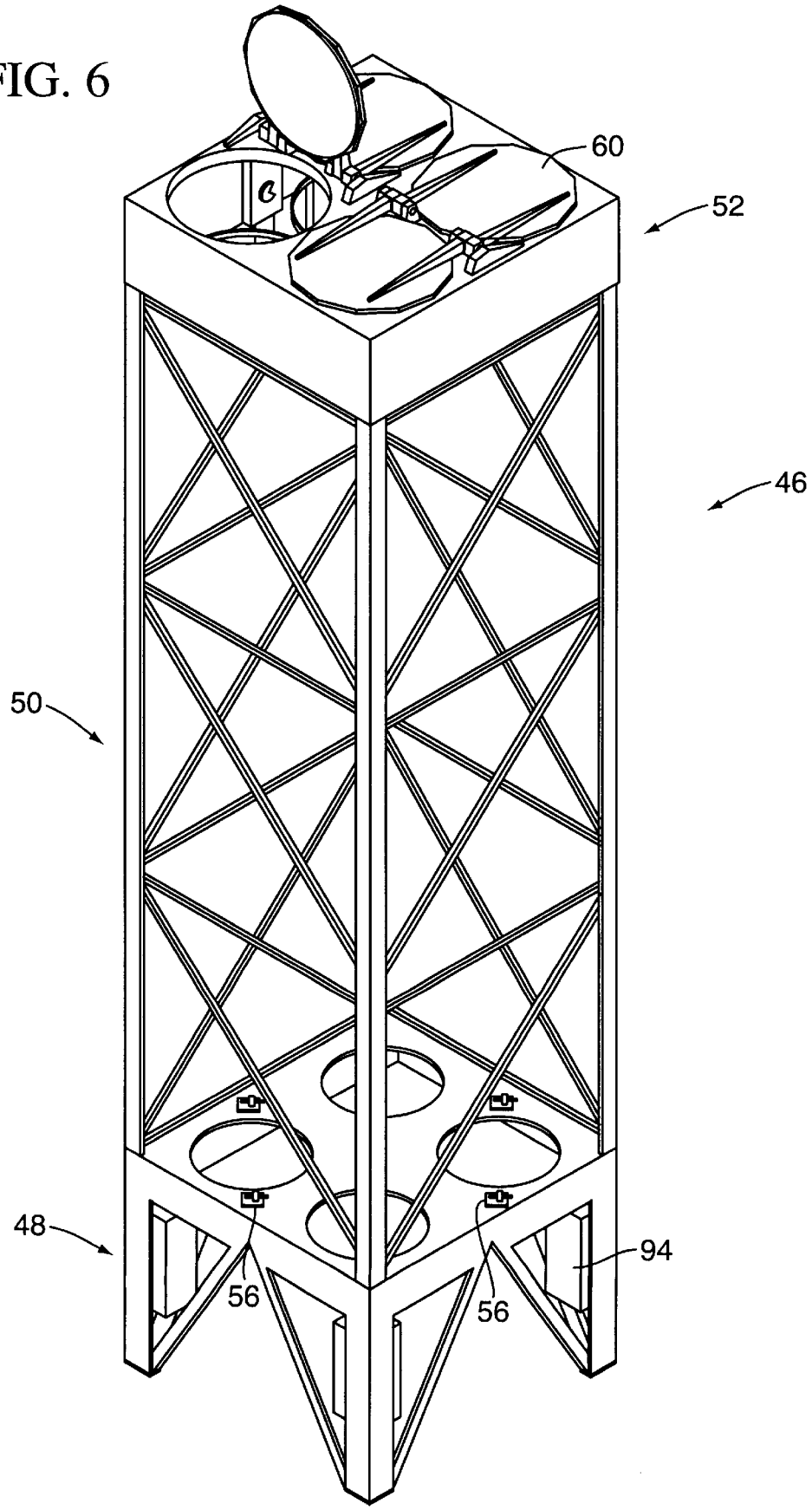
FIG. 6 is a view of a four cell module according to the present invention capable of holding four canisters as shown in FIG. 1.
Figure 7:
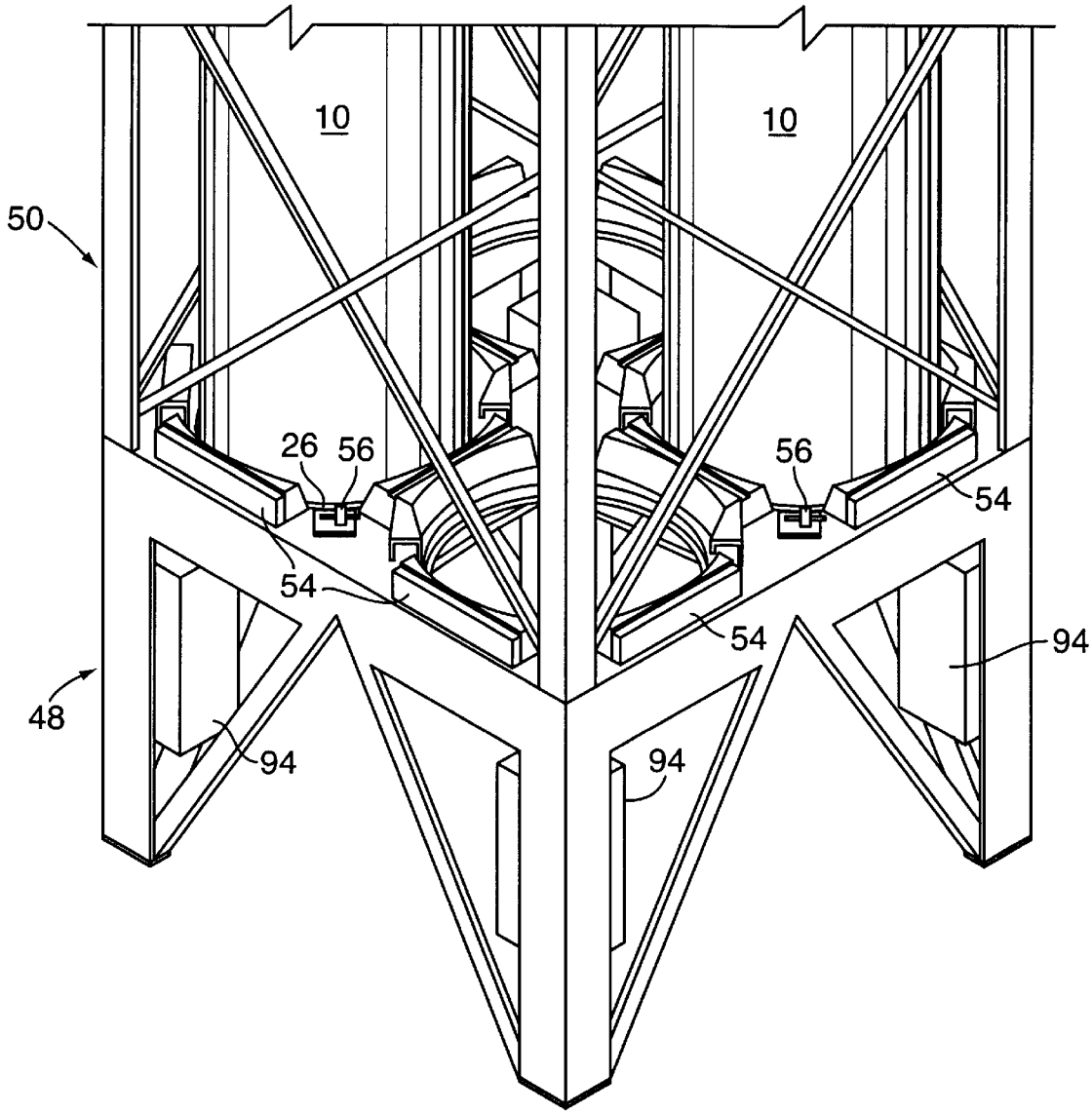
FIG. 7 is a more detailed view of the lower portion or base assembly of the module shown in FIG. 6.
Figure 8:
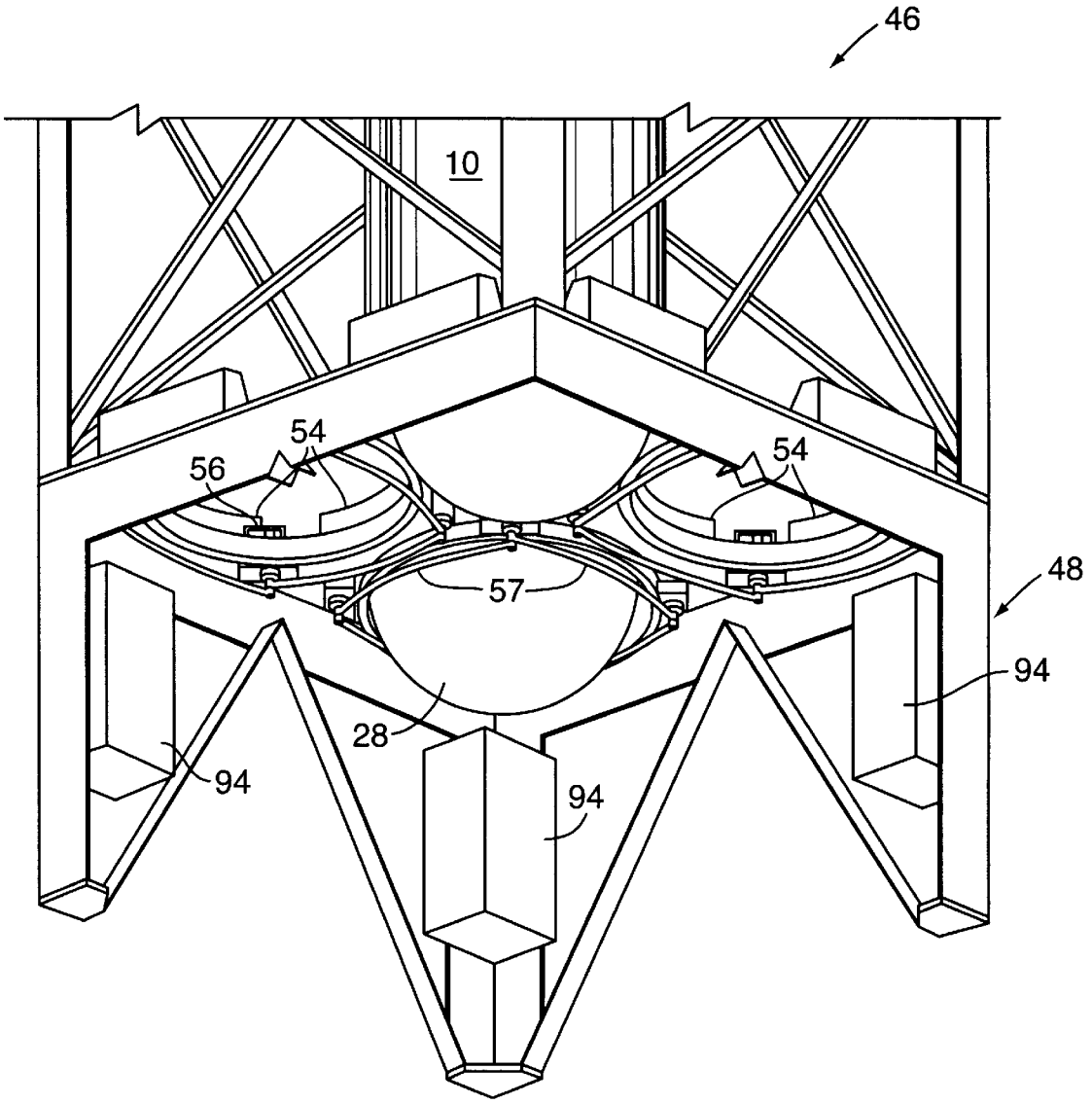
FIG. 8 is another view of the base assembly of FIG. 7 showing the dog down linkages for securing the canisters to the base assembly.

As shown in FIG. 6, four of the canisters may be arranged within a cell, indicated generally at 46, having a base assembly 48 capable of attachment within a ship, an intermediate structure 50 and an upper deck assembly 52. The base assembly 48, as best seen in FIGS. 7 and 8, includes a segmented socket 54 for each of the four canisters 10 having a shape complementary to the hemispherical head 28 for securing the canister 10 from radial movement relative to the base assembly 48 and to assist in properly locating the canister within the cell. For each of the canisters in the cell 46, four latches 56, which are commonly called dog down latches, are carried on the base assembly 48 and have projections on their upper ends which engage the lower flange 26 on the canister 10. Of the four latches, the one adjacent the corner of the cell is connected to a manually actuated lock mechanism which slides the associated latch in a slot angled toward the flange 26 so that the projection thereon engages the top of the flange 26. The lock mechanism is connected to the other three latches by links 57. Thus, movement of the lock mechanism will cause all four latches to a position in which the projections thereon engage the upper surface of the lower flange 26, thereby locking the canister 10 to the base assembly 48.

Figure 9:
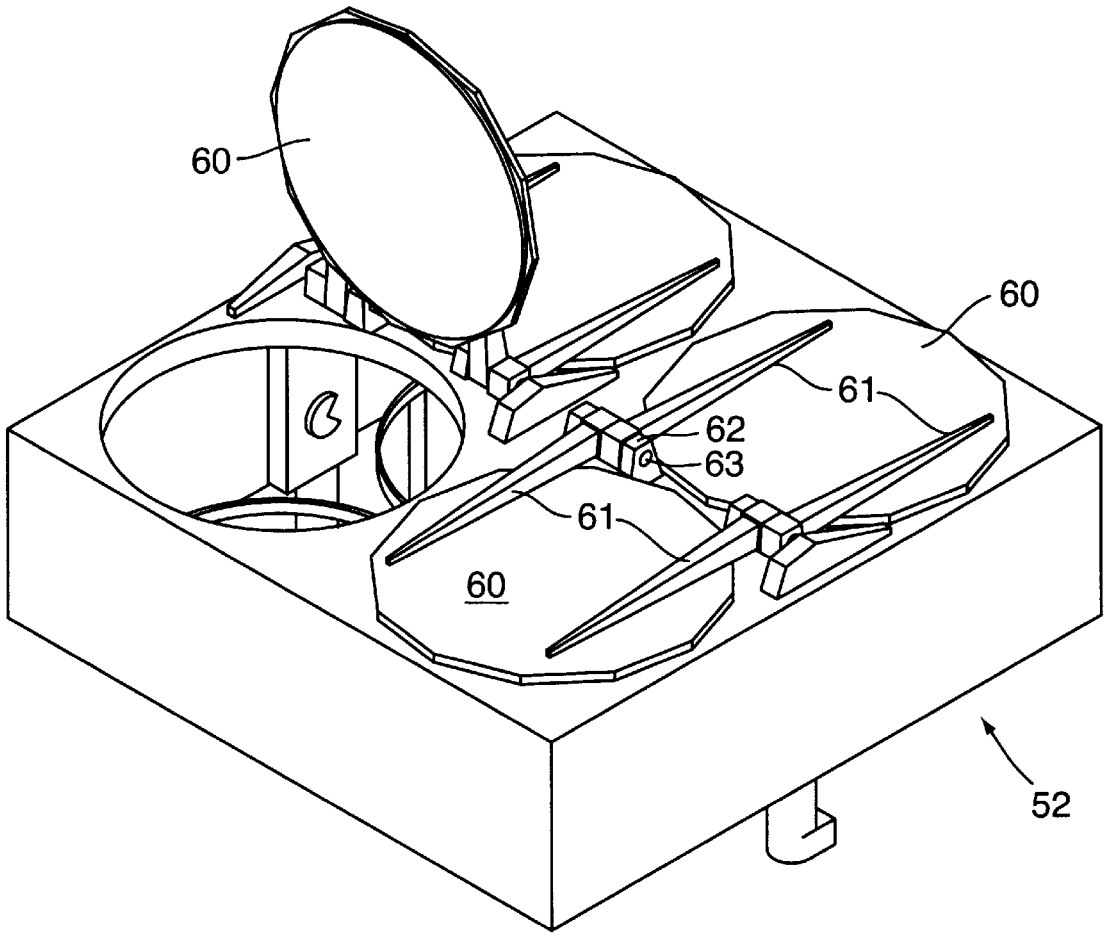
FIG. 9 is a more detailed view of the deck assembly portion of the module shown in FIG. 6.
Figure 10:
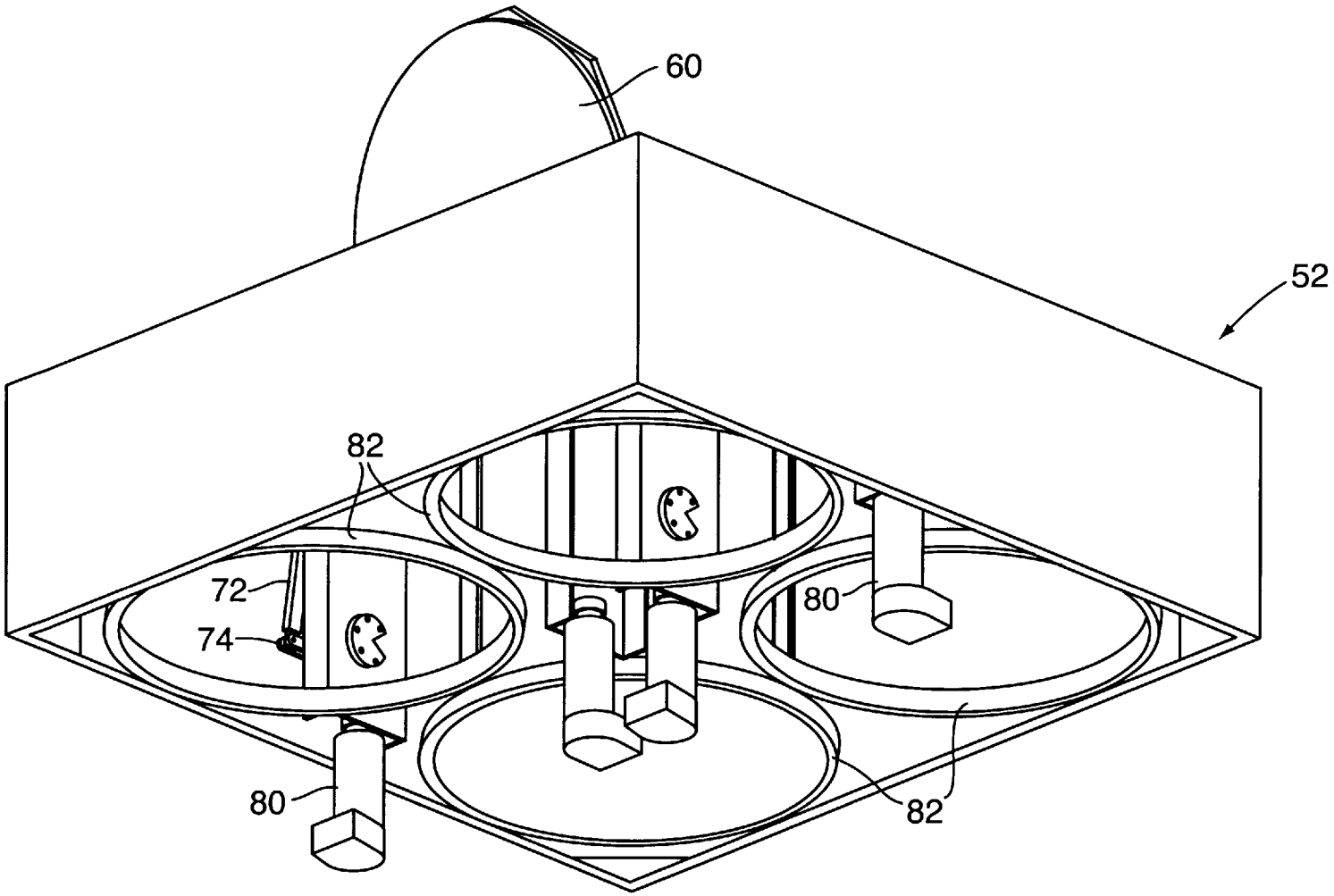
FIG. 10 is another view of the deck assembly shown in FIG. 9.
Figure 11:
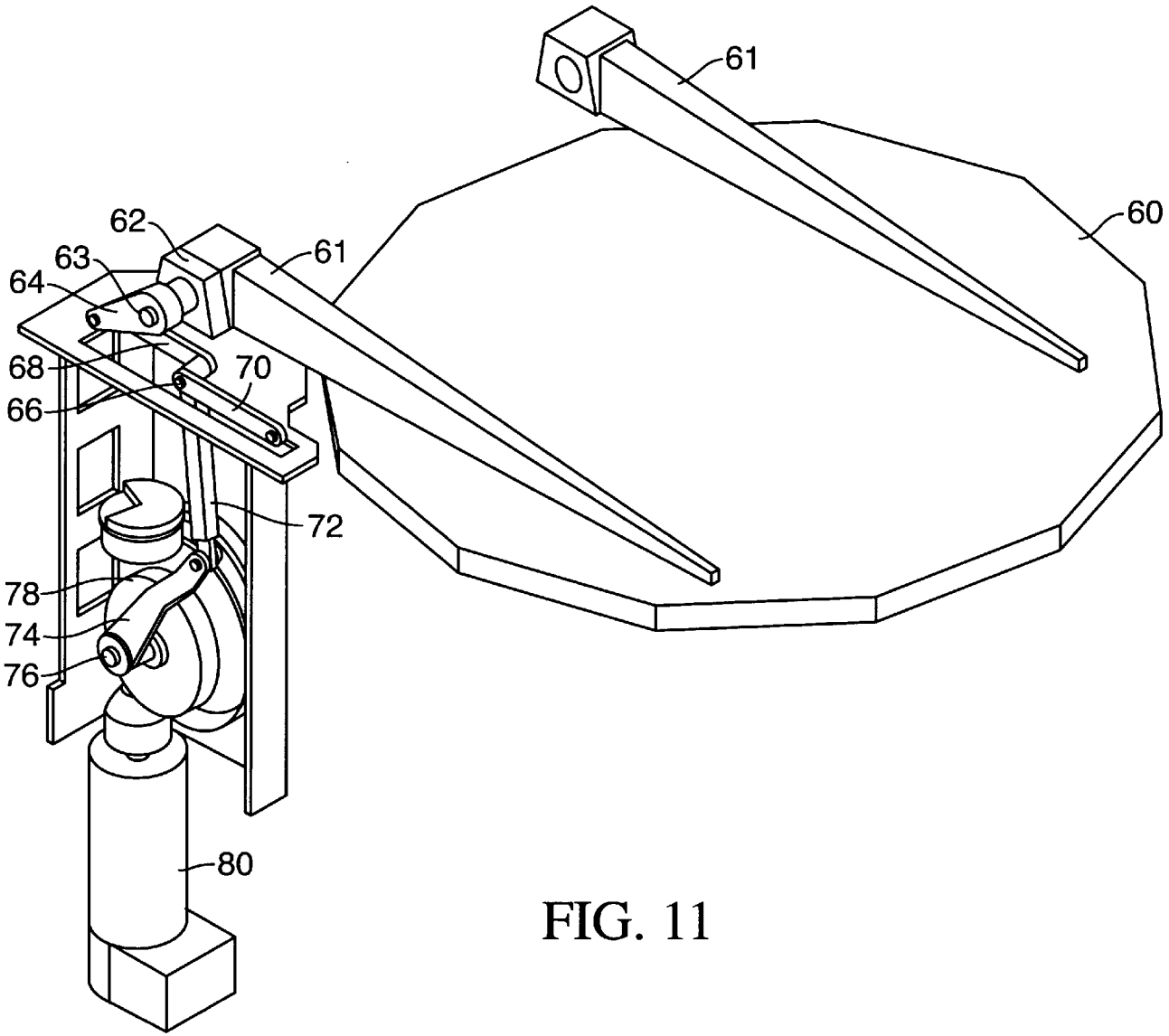
FIG. 11 is a more detail view of one of the hatch and associated drive assemblies for the deck assembly shown in FIGS. 9 and 10.

The deck assembly 52, as shown in FIGS. 9–11, which is intended for mounting on the upper deck of a ship, has a hatch 60 for each of the four canisters 10 in the cell 46. Each hatch 60 has a pair of arms 61 secured thereto with pins 63 extending through brackets 62 secured to the upper surface of the deck assembly 52. One of the pins 63 is non-rotatably secured to the associated arm and to a crank 64. A pin 66 pivotally connects a link 68 pinned to the crank 64, a drag link 70 pivotally connected to the deck assembly 52 and a connecting link 72. The connecting link 72 is also pinned to an actuating arm 74 which rotates with the output shaft 76 of a worm and wheel drive 78 which is powered by an electric motor 80. When the hatch 60 is closed the opening in the deck assembly covered thereby is sealed with the pin 66 going over-center, i.e. the pin 66 goes below the line between the pivotal connections of the link 68 to the crank 64 and of the drag link 70 to the deck assembly 52. With such an over-center arrangement, any force attempting to open the hatch 60 will only cause the hatch to be sealed more tightly. Guide rings 82 are secured within the deck assembly 52 to assist in loading the canister into the cell.

Figure 12:
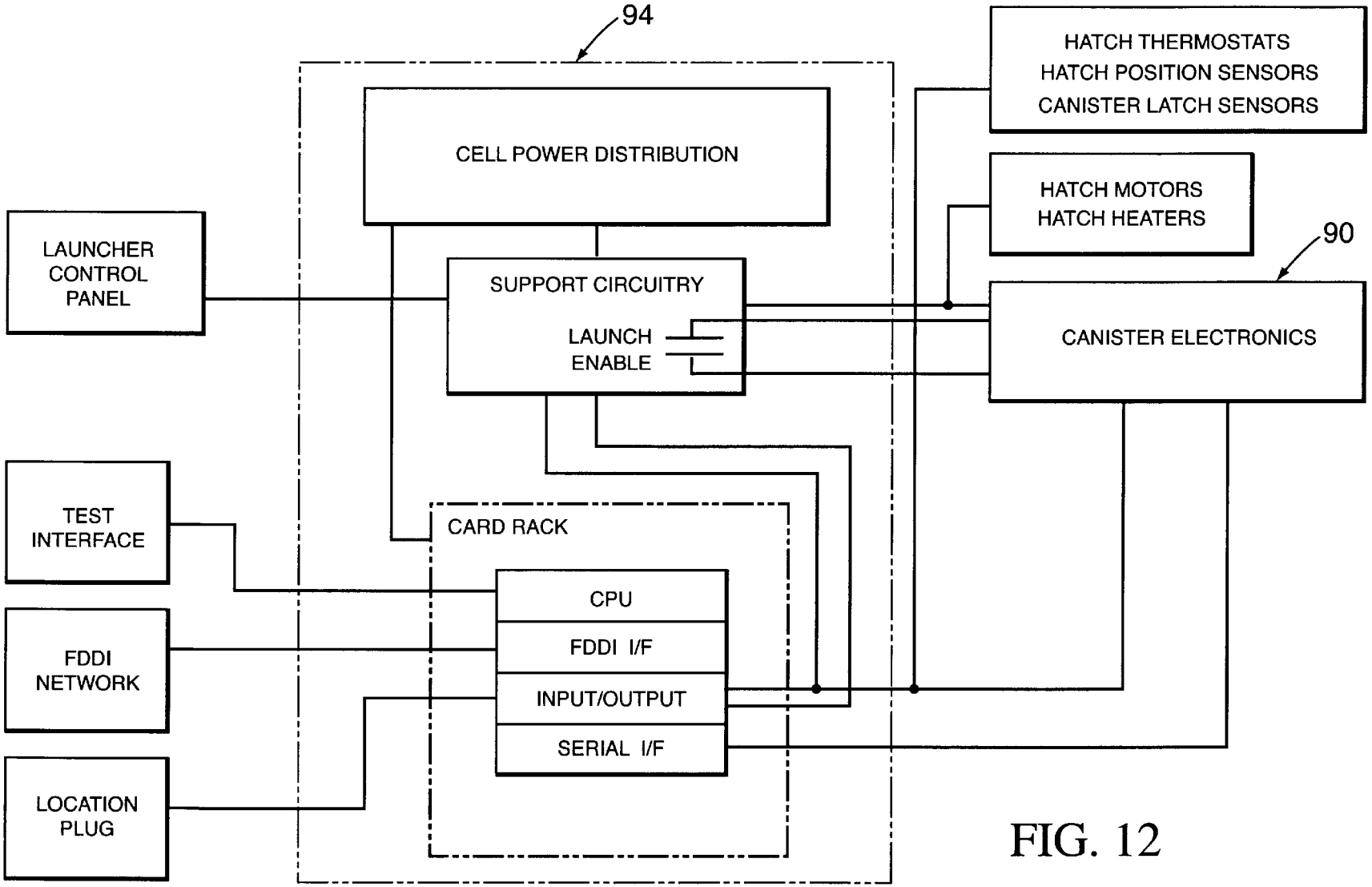
FIG. 12 is a block diagram of the electronics for a canister as shown in FIG. 1.
Figure 13:
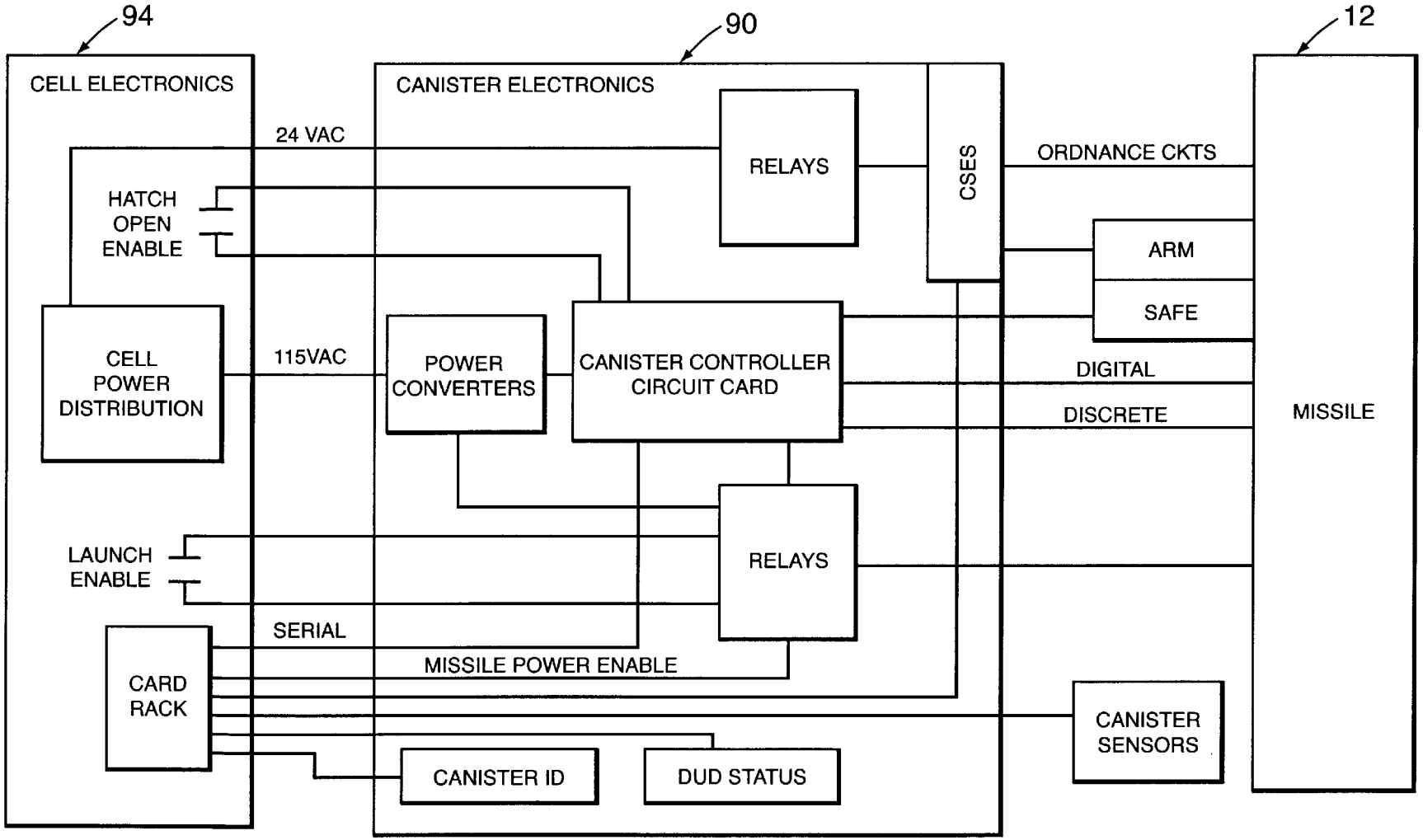
FIG. 13 is a block diagram of the electronics for the four cell module shown in FIG. 6.

The arrangement of the electronics provides an open architecture that renders the entire system versatile and economical. This is achieved by placing the electronics specific to the type of missile in the canister within the canister and the electronics needed for monitoring and control of the missile on the canister. The cell electronics are enclosed within a protective housing 90 as shown in FIGS. 3 and 4 with an umbilical cord 92 connecting the circuitry within the housing to the missile itself. The connection of the umbilical cord 92 to the missile includes a break-away connector to permit separation there between when the missile is launched. Another housing 94 mounted on each leg of the base assembly 48 contains all of the electronics for control and monitoring of the missile, which are connected to the canister electronics by a cord having a male connector capable of mating with the female connector on the housing 90. FIG. 13 is a block diagram of the canister electronics in the housing 90 showing its relationship to the missile 12 and the cell electronics in the housing 94 on the associated leg of the base assembly 48. FIG. 12 is a block diagram of the cell electronics and shows its relationship to the canister electronics and the launcher control panel, the canister electronics, and sensors and control of the hatch motors 80 and hatch heaters necessary for operation of the hatches in cold climates.

Some ships are not physically capable of accepting the launcher below deck, and some missile cannot be launched vertically because they lack the capability of turning into level flight. The present invention is adaptable to overcome either short coming by the arrangement shown in FIG. 14. In this embodiment, the launcher structure 98 is mounted at an angle to the vertical by the support structure 100. The lowered height permits mounting the entire launcher above deck, facilitating installation of the launcher on ships that cannot otherwise accommodate such a launcher, and can be used with missiles requiring a low launch angle.

In this embodiment each hatch such as 102 covers a pair of missiles such as 104 and 106. These missiles are each resident in a canister which is similar to the canister shown in FIG. I et seq. Thus surface 108 is inner tubular member similar in structure and function to the inner tubular member 16 of FIG. 2. Likewise, the fin pocket 110 of FIG. 14 is similar to the U-shaped fin pocket shown at 20 in FIG. 2.

Figure 2:
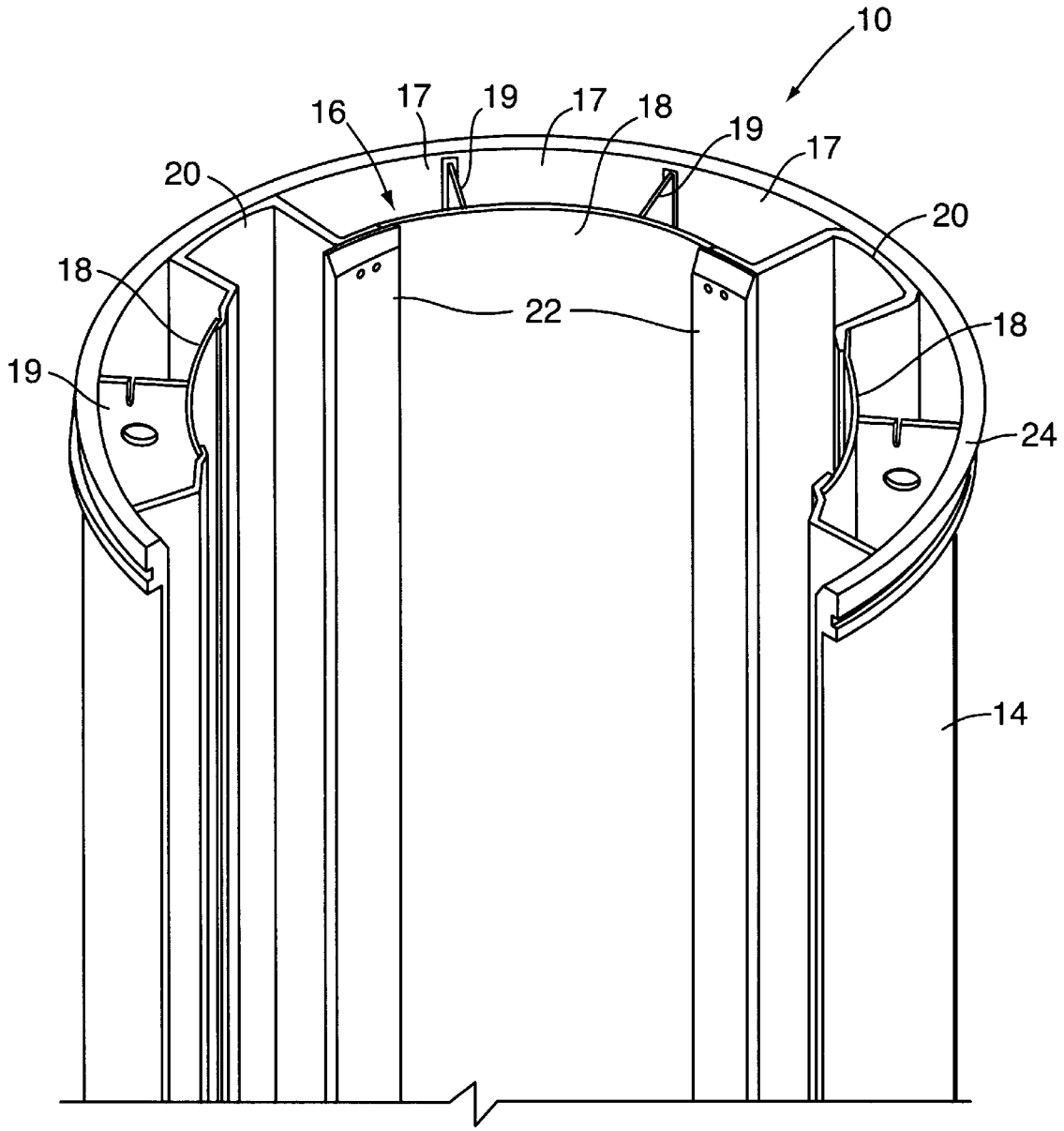
FIG. 2 is a more detailed view of the upper portion of the canister shown in FIG. 1.

Each of the canisters 112 and 114 will have structures identical to those shown for the FIG. 1–3 canisters except that the hatch will be controlled by a single over-center latch operating through and with the hinge 120. The hatch actuating mechanism will be contained in housing 116.

Figure 14:
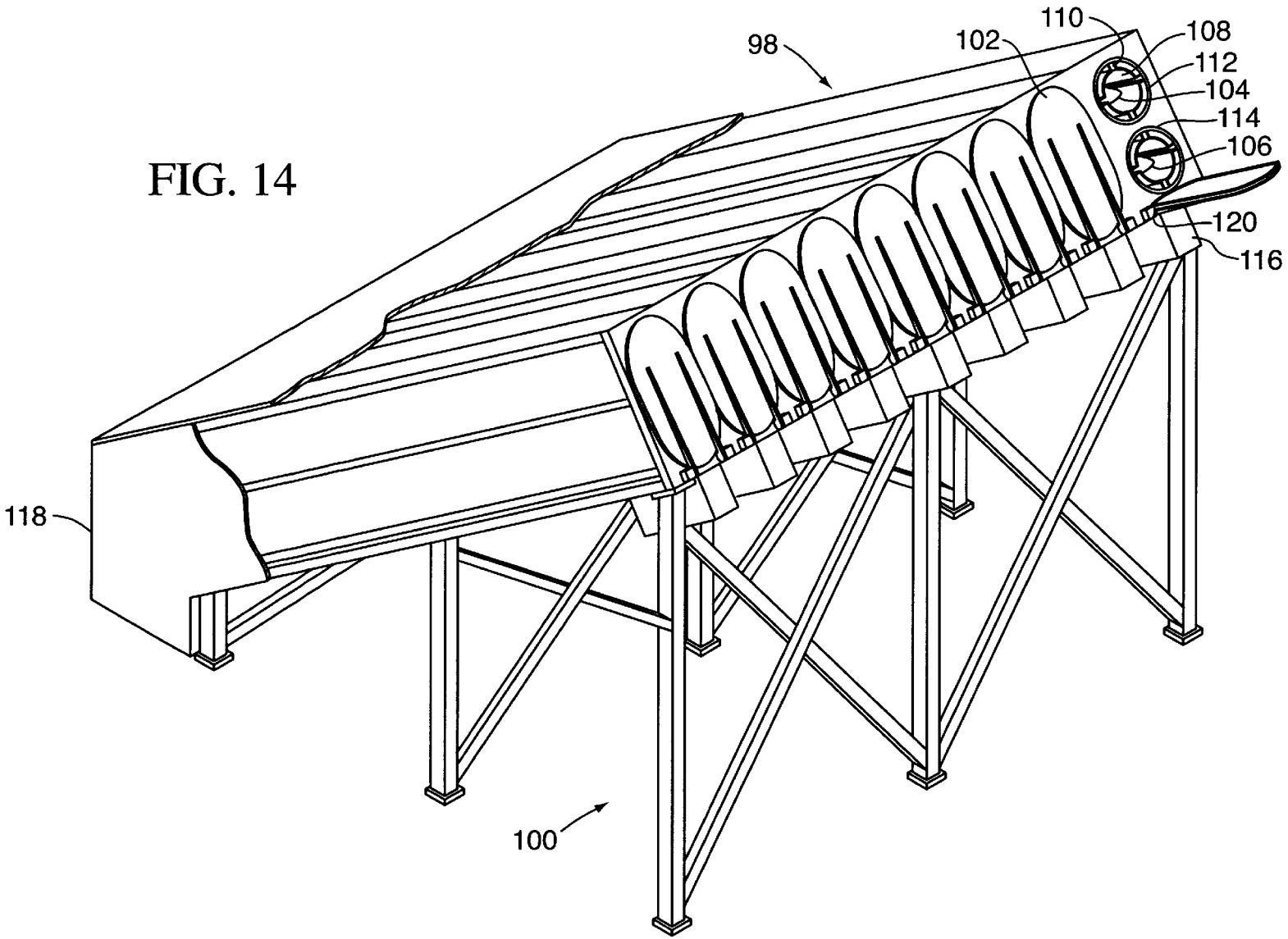
FIG. 14 is a view of another embodiment of the present invention showing an arrangement for mounting a launcher above deck.

Each of the nine missile canisters in this FIG. 14 are identical, thus providing 18 missile capacity from this launcher. It is expected that arrays of between two and any number of missile tubes could be arranged in a structure as shown in FIG. 14.

The housing 118 may cover the array and also, in this view, covers the apparatus shown in FIG. 7 and FIG. 8 including the electrical connections with housing 94 and the latch mechanism such as 56.

While various embodiments of the present invention have been shown and described herein, it is to be understood that various changes and modifications may be made without departing from the spirit of the invention, as defined by the scope of the following claims.

What is claimed is:

1. The combination of a canister and a missile for launching the latter, said missile capable of generating high pressure exhaust gases when fired comprising:

a cylindrical outer tube having upper and lower ends;

a hemispherical head secured to and enclosing the lower end of said outer tube;

an inner tubular member spaced from said outer tube to form an uptake passage;

stiffeners connected between said outer tube and inner tubular member to minimize the deflection of said outer tube away from said inner tubular member and the deflection of said inner tubular member away from said outer tube under the pressure of said gases;

a base plate for supporting said missile, said base plate being connected to one of said outer tube and said inner tubular member;

said uptake passage extending from below said base plate to the upper end of said outer tube;

shock absorbers interposed between said base plate and one of said outer tube and said inner tubular member;

a restraint mechanism for securing the missile to said base plate; and a release mechanism responsive to the firing of the missile for disabling said restraint mechanism;

whereby the gases generate by the firing of the missile are diverted by said head into said uptake passage and exit from the upper end of said outer tube.

* * * * *